US007992532B2

(12) United States Patent
Bugescu et al.

(10) Patent No.: US 7,992,532 B2
(45) Date of Patent: Aug. 9, 2011

(54) SWITCHABLE HYDRAULIC LASH ADJUSTER WITH SPHERICAL LOCKING PINS

(75) Inventors: Florin Bugescu, Canton, MI (US); Richard Best, Orem, UT (US)

(73) Assignee: Schaeffler KG, Herzogenaurach (DE)

( * ) Notice: Subject to any disclaimer, the term of this patent is extended or adjusted under 35 U.S.C. 154(b) by 415 days.

(21) Appl. No.: 12/336,660

(22) Filed: Dec. 17, 2008

(65) Prior Publication Data

US 2009/0159030 A1 Jun. 25, 2009

Related U.S. Application Data

(60) Provisional application No. 61/015,834, filed on Dec. 21, 2007.

(51) Int. Cl.
*F01L 1/14* (2006.01)

(52) U.S. Cl. ..... 123/90.52; 123/90.48; 123/90.16

(58) Field of Classification Search ..... 123/90.16, 123/90.48, 90.52, 90.55
See application file for complete search history.

(56) References Cited

U.S. PATENT DOCUMENTS 6,732,687 B2 * 5/2004 Djordjevic ..... 123/90.16

* cited by examiner

*Primary Examiner* — Zelalem Eshete
(74) *Attorney, Agent, or Firm* — Lucas & Mercanti, LLP

(57) ABSTRACT

The switchable hydraulic lash adjuster uses balls that move radially in order to lock and unlock the switchable elements in the hydraulic lash adjuster. An axially movable piston acts on the ball to force it to engage and to allow it to disengage the inner housing.

10 Claims, 6 Drawing Sheets

SWITCHABLE HYDRAULIC LASH ADJUSTER WITH SPHERICAL LOCKING PINS

BACKGROUND OF THE INVENTION

This Invention relates to switchable hydraulic lash adjusters and, more specifically, to the locking mechanism employed in such switchable hydraulic lash adjusters.

FIELD OF THE INVENTION

Switchable hydraulic lash adjusters offer a better engine efficiency compared to traditional valve trains. The switchable hydraulic lash adjuster that is used in OHC valve trains, is usually activated/deactivated by two locking pins that are hydraulically moved to engage and disengage the outer housing of the assembly. Such pins move in a planar, radial direction.

OBJECT OF THE INVENTION

The object of the Invention is to provide a simple design for the activation/deactivation of the switchable element in a hydraulic lash adjuster. It is also the object of the present Invention to reduce the overall height of the switchable hydraulic lash adjuster.

These and other objects of the present Invention may be readily understood by reference to the following description of the Invention.

SUMMARY OF THE INVENTION

The objects of the Invention are achieved by employing radially movable balls as the locking element where the balls are activated by an axially movable piston mounted on the outer housing of the lash adjuster.

Broadly, the present Invention can be defined as a switchable hydraulic lash adjuster comprising:

- an outer cylindrical housing having a first internal axial cylindrical blind bore;
- an inner cylindrical housing slidably mounted at an open end of the first bore, the inner housing having a second internal axial cylindrical blind bore;
- a lash adjuster piston slidably mounted at an open end of the second bore;
- a lost motion spring mounted in the first bore between a bottom of the inner housing and a closed end of the first bore;
- a radial hole extending through a side wall of the outer housing;
- an inner indent in a side wall of the inner housing;
- a ball housed in the radial hole and radially movable between a locked position where the ball engages the indent and the radial hole so that the inner housing is locked to the outer housing and an unlocked position where the ball is in the radial hole and disengages from the indent so that the inner housing is unlocked from the outer housing;
- a piston axially movably mounted outside the outer housing, the piston having a radial bearing surface and a radial outer indent, the piston axially movable on the outside of the outer housing between a first position where the bearing surface pushes the ball into engagement with the inner indent and the ball is in the locked position and a second position where the outer indent engages the ball and the ball disengages from the inner indent and the ball is in the unlocked position; and
- a ball return spring housed in a side wall of the first bore at the radial hole and urging the ball into the unlocked position.

Preferably, the outer housing has an axial groove in which the piston is movable.

A piston spring is positioned at the end of the piston and urges the piston into the first position.

Preferably, the piston is a cylindrical ring that encircles the outer housing.

Preferably, the lash adjuster has multiple radial holes which each house a ball therein. The inner housing has indents to accommodate each one of the balls and the piston acts on each of the balls uniformly.

Preferably, the side wall of the first bore has a radial groove to house the ball return springs. More preferably, there are two ball return springs and two radial grooves, one to house each of the return springs.

BRIEF DESCRIPTION OF THE DRAWINGS

These and other aspects of the present Invention may be readily understood by one or more of the following drawings.

DETAILED DESCRIPTION OF THE DRAWINGS

Figure 1:
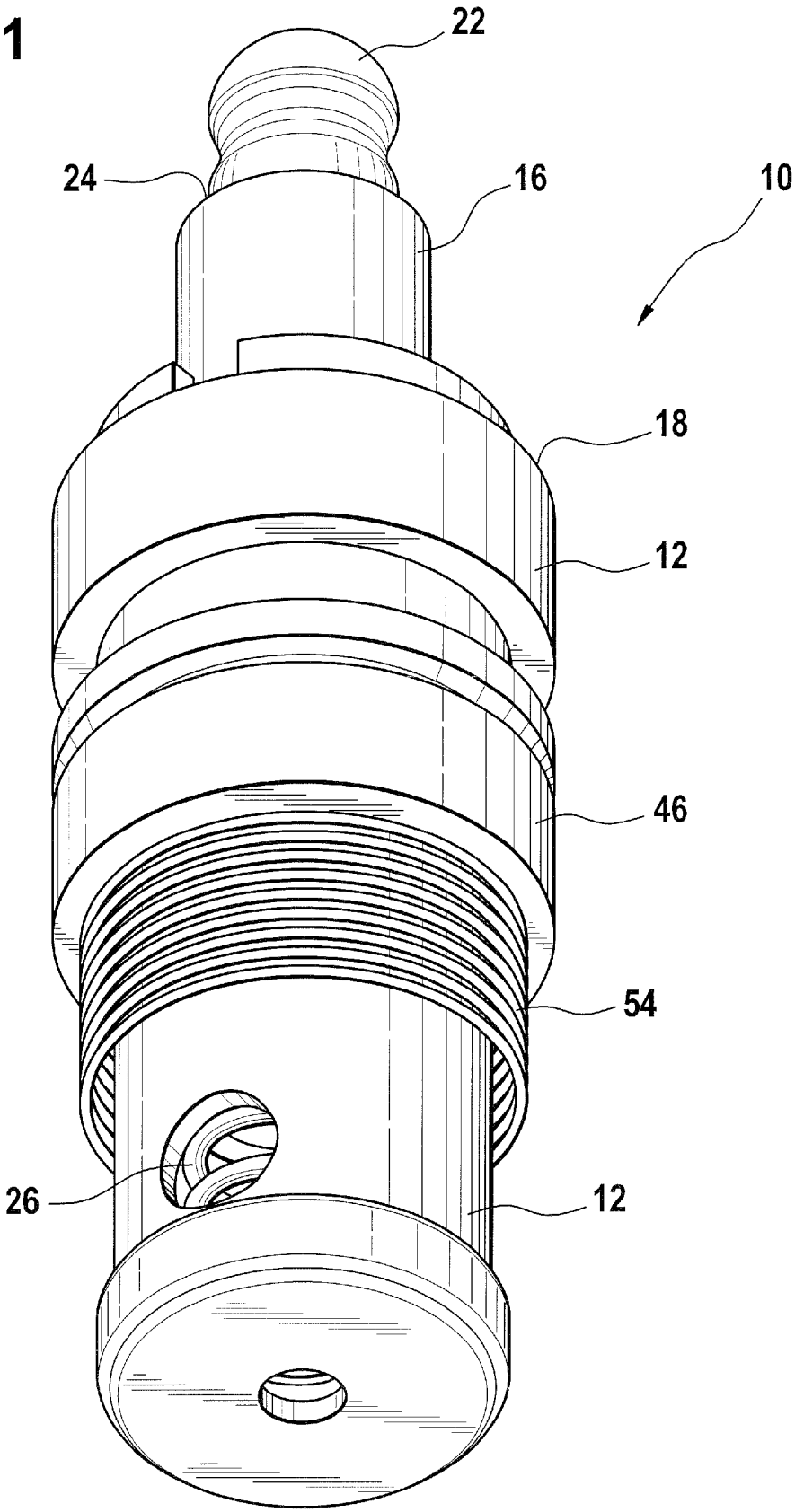
FIG. 1 is an outside perspective view of the switchable hydraulic lash adjuster of the present Invention.

FIG. 1 illustrates switchable hydraulic lash adjuster 10 having outer housing 12 with first internal axial cylindrical blind bore 14. Inner cylindrical housing 16 is slidably mounted at open end 18 of bore 14. Inner housing 16 has a second internal axial cylindrical blind bore 20 therein. Lash adjuster 22 is slidably mounted at open end 24 of inner housing 16. Lost motion spring 26 is mounted in first bore 14 between bottom 28 of inner housing 16 and closed end 30 of first bore 14, see FIG. 2.

Figure 2:
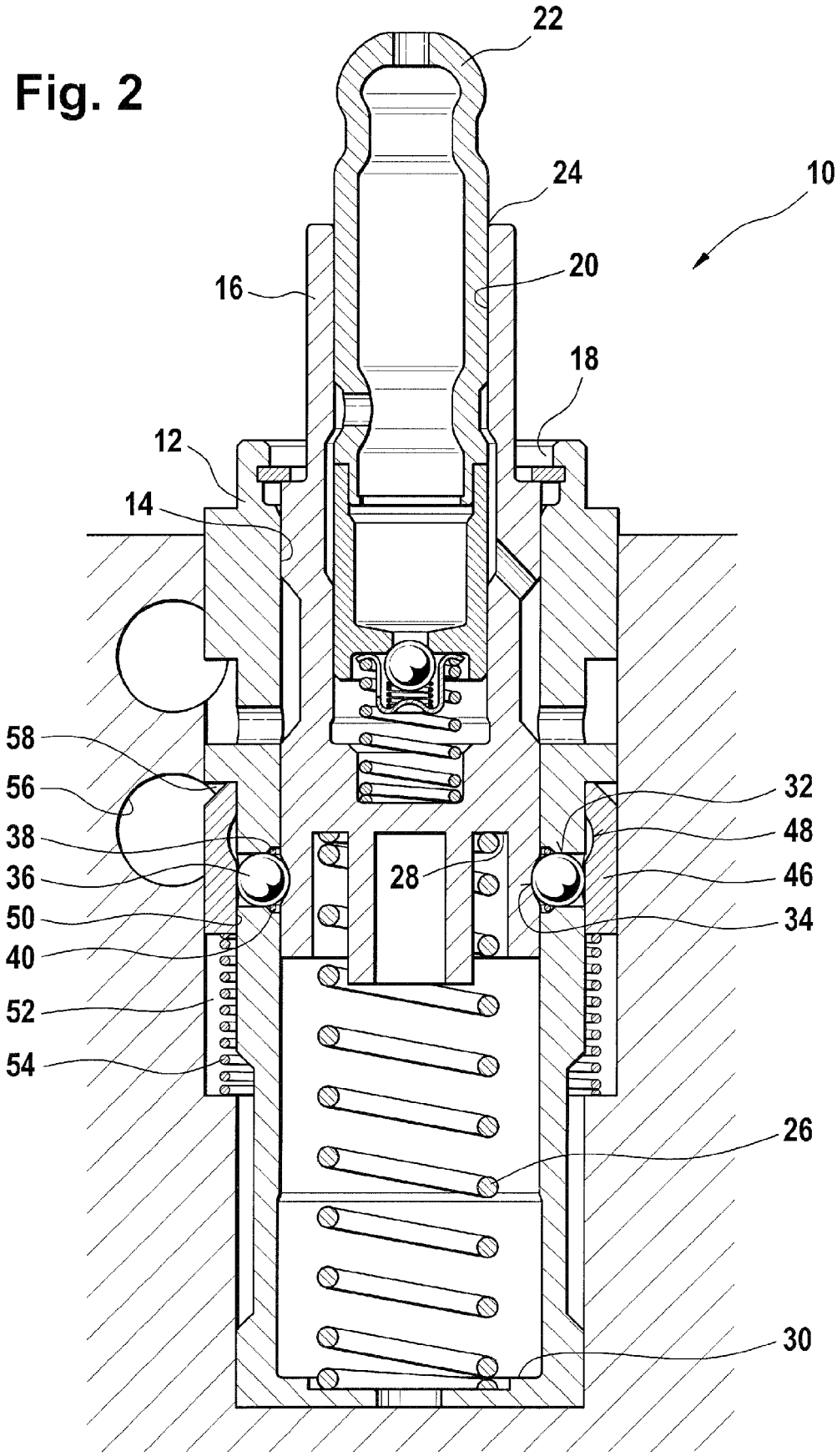
FIG. 2 is a cross section of the switchable hydraulic lash adjuster of the present Invention in the locked position.

FIG. 2 illustrates switchable hydraulic lash adjuster 10 in a locked position. Outer housing 12 has radial holes 32 and inner housing 16 has indent 34. Balls 36 engage inner indent 34 and radial hole 32 to lock inner housing 16 to outer housing 12. Top return ball spring 38 and bottom return ball spring 40 are positioned above and below ball 36 and are housed in top radial groove 42 and bottom radial groove 44, respectively. Piston 46 has radial outer indent 48 and radial bearing surface 50. When radial bearing surface 50 presses against ball 36, it forces ball 36 into inner indent 34 and thereby maintains the locked position. When piston 46 moves axially in axial groove 52 in a downward motion, radial outer indent 48 engages the back of ball 36 and return ball springs 40 and 42 cause ball 36 to disengage inner indent 34 thereby unlocking outer housing 12 from inner housing 16. Piston spring 54 urges piston 46 upward and thereby urging ball 36 into the locked position. When oil from conventional oil pressure system is pumped through oil hole 56, it acts on pressure camber 58 to force piston 46 downward.

As can be seen, the default mode is the locked mode because piston spring 54 urges piston 46 upward.

Figure 3:
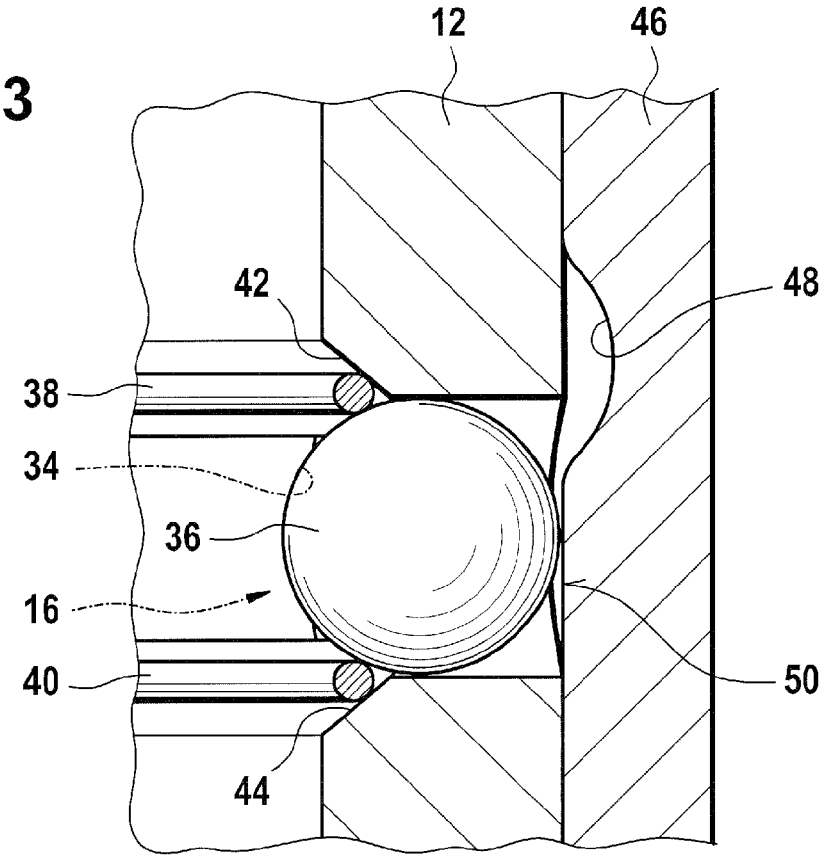
FIG. 3 is a detailed drawing illustrating the locked position between the piston, the outer housing and the inner housing showing an axial direction.

FIG. 3 illustrates a more enlarged view of the locked position better illustrating bearing surface 50 forcing ball 36 into indent 34.

Figure 4:
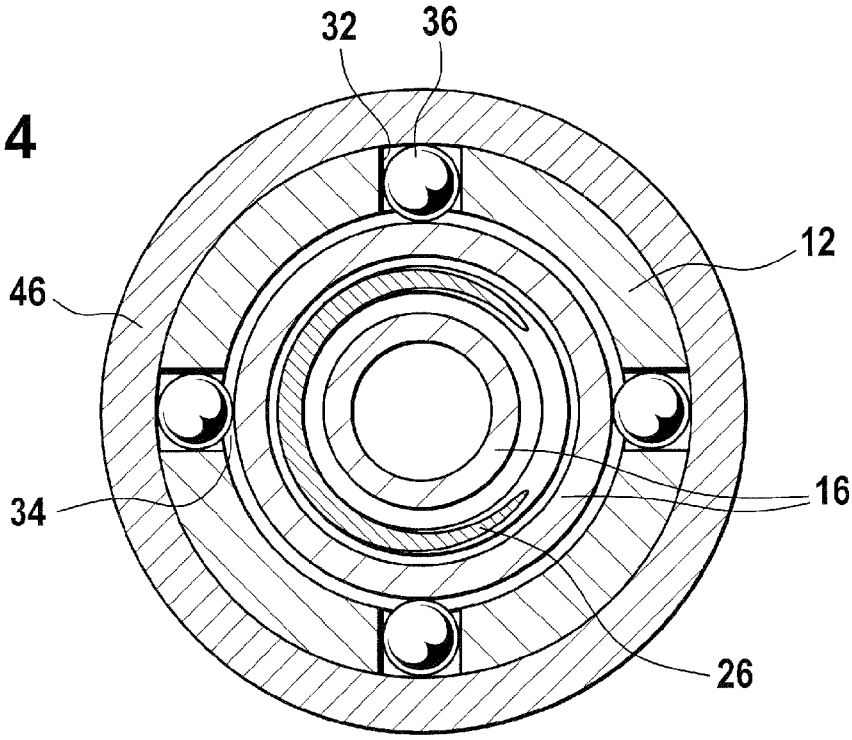
FIG. 4 is a detailed drawing showing the switchable hydraulic lash adjuster in the locked position taken as a cross section in the radial direction.

FIG. 4 is a radial view through balls 36 showing piston 46 urging balls inward to engage inner indent 34 on inner housing 16.

Figure 5:
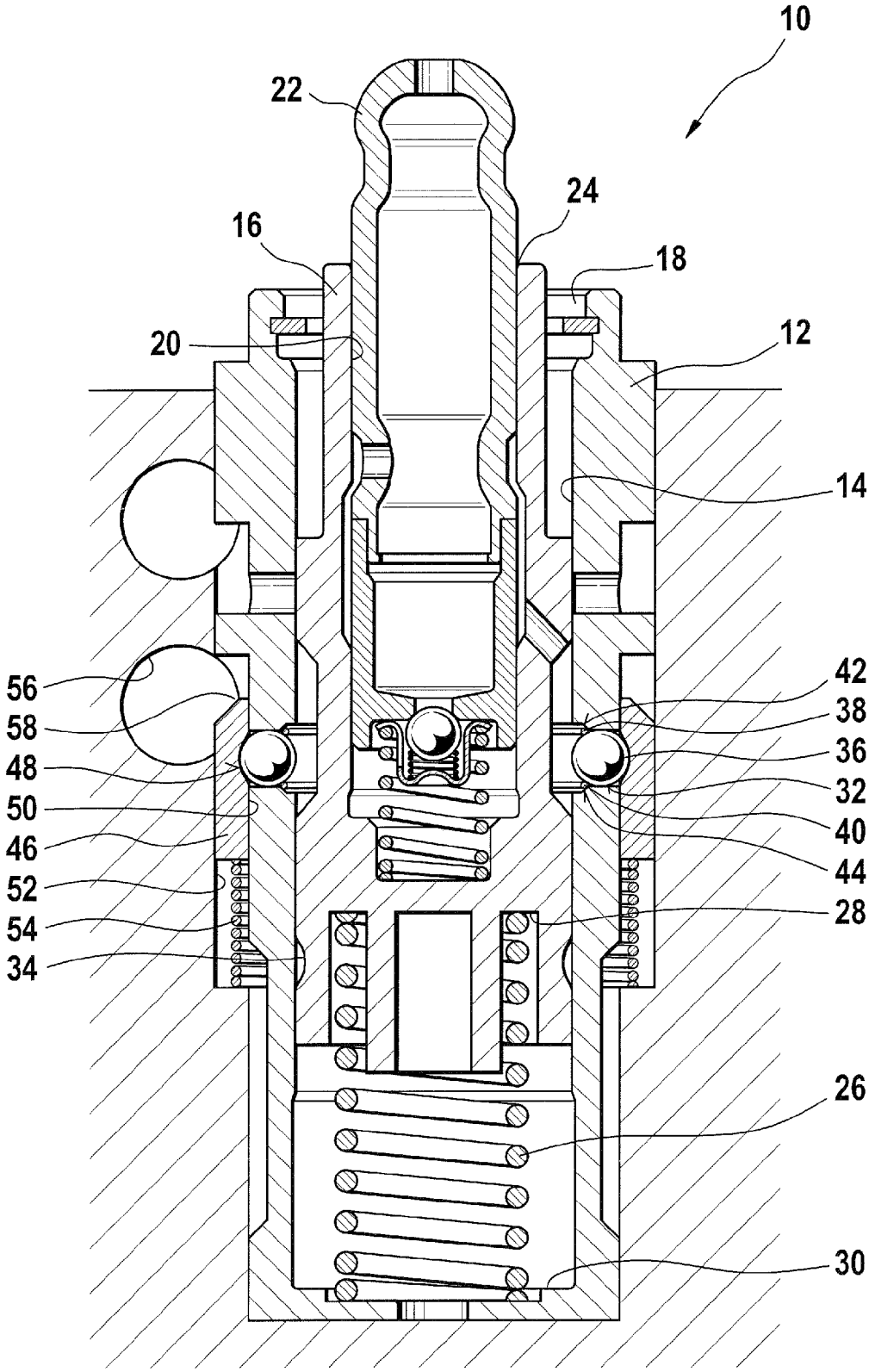
FIG. 5 is an axial cross section of the switchable hydraulic lash adjuster in the unlocked position.

FIG. 5 illustrates adjuster 10 in the unlocked position. In the unlocked position, hydraulic fluid pumped through oil hole 56 applies downward pressure on pressure camber 58 to force piston 56 downward such that outer indent 48 engages ball 36 and return ball spring 38 and 40 press ball 36 into engagement with outer intent 48.

Figure 6:
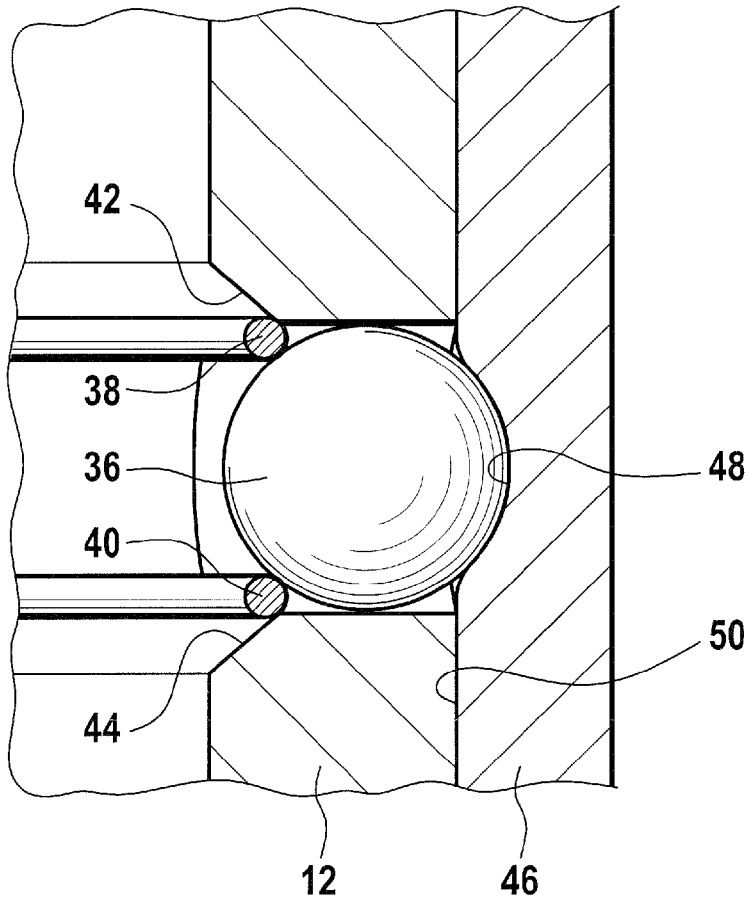
FIG. 6 is a detailed drawing showing the unlocked position for the ball.

FIG. 6 provides a detailed illustration of the unlocked mode for ball 36 and piston 46. As can be seen, springs 38 and 40 have moved in grooves 42 and 44 compared to their position in FIG. 3.

Figure 7:
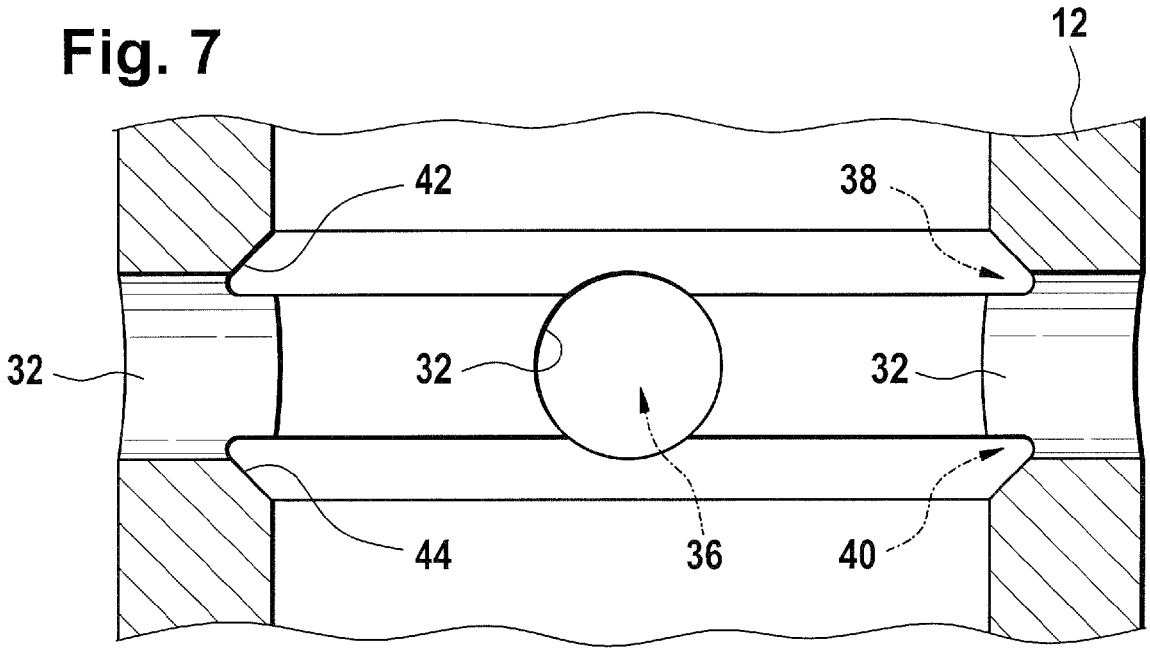
FIG. 7 illustrates the ball return springs and the ball.

FIG. 7 illustrates return springs 38 and 40 with ball 36 viewed from inside of first bore 14 looking outward.

Figure 8:
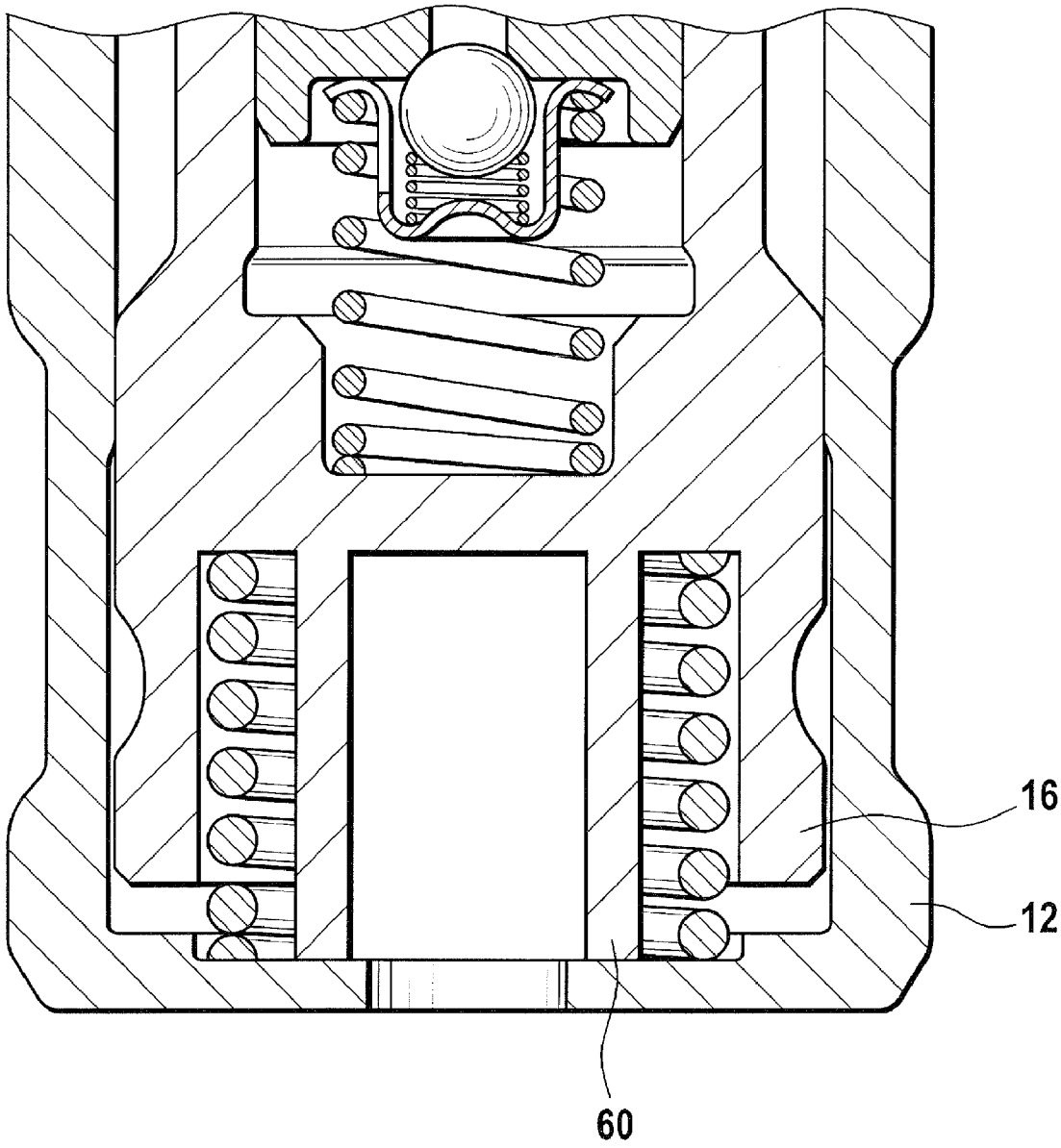
FIG. 8 illustrates the inner housing with a stop for mis-switch situations.

FIG. 8 illustrates stop 60 which is used for mis-switch situations. In actual solution the spring is the stopper and the inner housing has stop 60 which hits bottom 28 of outer housing 12.

REFERENCE CHARACTERS

10. Switch hydraulic lash adjuster
12. Outer cylindrical housing
14. First internal axial cylindrical blind bore
16. Inner cylindrical housing
18. Open end
20. Second internal axial cylindrical blind bore
22. Lash adjuster piston
24. Open end
26. Lost motion spring
28. Bottom
30. Closed end
32. Radial hole
34. Inner indent
36. Ball
38. Top return ball springs
40. Bottom return ball springs
42. Top radial groove
44. Bottom radial groove
46. Piston
48. Radial outer indent
50. Radial bearing surface
52. Axial groove
54. Piston spring
56. Oil hole
58. Pressure camber
60. Stop

What we claim is:

1. A switchable hydraulic lash adjuster comprising:

(a) an outer cylindrical housing having a first internal, axial, cylindrical blind bore;

(b) an inner cylindrical housing slidably mounted at an open end of the first bore, the inner housing having a second internal, axial, cylindrical blind bore;

(c) a lash adjuster piston slidably mounted at an open end of the second bore;

(d) a lost motion spring mounted in the first bore between a bottom of the inner housing and a closed end of the first bore;

(e) a radial hole extending through a side wall of the outer housing;

(f) an inner indent in a side wall of the inner housing;

(g) a ball housed in the radial hole and radially movable between a locked position where the ball engages the indent and the radial hole so that the inner housing is locked to the outer housing and an unlocked position where the ball is in the radial hole and disengages from the indent so that the inner housing is unlocked from the outer housing;

(h) a piston axially, movably mounted outside the outer housing, the piston having a radial bearing surface and a radially outer indent, the piston axially movable on the outside of the outer housing between a first position where the bearing surface pushes the ball into engagement with the inner indent and the ball is in the locked position and a second position where the outer indent engages the ball and the ball disengages from the inner indent and the ball is in the unlocked position; and (i) a ball return spring housed on a side wall of the first bore as the radial hole and urging the ball into the unlocked position.

2. The adjuster of claim 1, wherein the outer housing has an axial groove in which the piston is mounted.

3. The adjuster of claim 1, wherein a piston spring is positioned at an end of the piston and the spring urges the piston into the first position.

4. The adjuster of claim 1, wherein the piston is a cylindrical ring that encircles the outer housing.

5. The adjuster of claim 1, wherein two ball return springs are positioned at the radial hole, one at an axial top and the other at the axial bottom of the radial hole.

6. The adjuster of claim 1, wherein the side wall of the first bore has a radial groove to the house the ball return spring.

7. The adjuster of claim 1, wherein the radial hole is a plurality of radial holes, each with a ball.

8. The adjuster of claim 7, wherein the piston is a cylindrical ring that encircles the outer housing and acts on all of the balls.

9. The adjuster of claim 8, wherein a piston spring is positioned at an end of the piston, encircles the outer housing and urges the piston into the first position.

10. The adjuster of claim 5, wherein the side wall of the first bore has two radial grooves, one radial groove to house one ball return spring and the other radial groove to house the other ball return spring.

* * * * *